US011702931B2

(12) United States Patent
Inyang et al.

(10) Patent No.: US 11,702,931 B2
(45) Date of Patent: Jul. 18, 2023

(54) REAL-TIME WELL BASHING DECISION

(71) Applicant: Halliburton Energy Services, Inc., Houston, TX (US)

(72) Inventors: Ubong Inyang, Humble, TX (US); Srinath Madasu, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 403 days.

(21) Appl. No.: 16/340,441

(22) PCT Filed: Nov. 7, 2016

(86) PCT No.: PCT/US2016/060836

§ 371 (c)(1),
(2) Date: Apr. 9, 2019

(87) PCT Pub. No.: WO2018/084870

PCT Pub. Date: May 11, 2018

(65) Prior Publication Data

US 2019/0309618 A1 Oct. 10, 2019

(51) Int. Cl.
*E21B 47/10* (2012.01)
*E21B 33/13* (2006.01)
(Continued)

(52) U.S. Cl.
CPC ..... *E21B 47/10* (2013.01); *E21B 33/13* (2013.01); *E21B 43/26* (2013.01); *E21B 47/06* (2013.01);
(Continued)

(58) Field of Classification Search
CPC ..... E21B 47/10; E21B 47/07; E21B 47/06; E21B 47/09; E21B 49/00; E21B 49/006; E21B 33/13; E21B 43/26
See application file for complete search history.

(56) References Cited

U.S. PATENT DOCUMENTS

2008/0142212 A1* 6/2008 Hartog ..... E21B 17/026 166/250.07
2012/0116681 A1* 5/2012 Fuller ..... E21B 47/0224 702/12
(Continued)

FOREIGN PATENT DOCUMENTS

WO 2014165375 10/2014
WO 2015069817 5/2015
(Continued)

OTHER PUBLICATIONS

ISRWO International Search Report and Written Opinion for PCT/US2016/060836 dated Jul. 27, 2017.
(Continued)

*Primary Examiner* — Christopher J Sebesta
(74) *Attorney, Agent, or Firm* — Thomas Rooney; C. Tumey Law Group PLLC

(57) ABSTRACT

A system includes a processor(s), and a memory coupled to the processor(s) having instructions stored therein. When executed by the processor(s), the instructions cause the processor(s) to perform functions to: apply a treatment for stimulating production to at least a first well in a subterranean formation; determine a flow distribution based on at least one of a first-well measurement or a second-well measurement, the first-well measurement taken at the first well, and the second-well measurement taken at a second well; determine a length of a fracture between the first and second wells, based on the determined flow distribution; determine if the applied treatment at the first well interferes with the second well, based on the determined length of the fracture; and apply a diverting material at the first well if it is determined that the applied treatment interferes with the second well, in order to control well bashing.

18 Claims, 6 Drawing Sheets

(51) Int. Cl.

| | |
|---|---|
| ***E21B 43/26*** | (2006.01) |
| ***E21B 47/06*** | (2012.01) |
| ***E21B 49/00*** | (2006.01) |
| ***E21B 47/09*** | (2012.01) |
| ***E21B 47/07*** | (2012.01) |

(52) U.S. Cl.
CPC ..... *E21B 47/07* (2020.05); *E21B 47/09* (2013.01); *E21B 49/00* (2013.01); *E21B 49/006* (2013.01)

(56) References Cited

U.S. PATENT DOCUMENTS

2012/0267104 A1* 10/2012 Clarkson ..... E21B 43/267 166/280.1
2012/0318500 A1* 12/2012 Urbancic ..... G01V 1/288 166/250.1
2013/0168082 A1 7/2013 Clark et al.
2014/0347192 A1* 11/2014 Barfoot ..... E21B 47/135 340/854.7
2014/0352968 A1* 12/2014 Pitcher ..... E21B 43/26 166/308.1
2015/0075778 A1* 3/2015 Walters ..... E21B 47/06 166/250.1
2016/0326859 A1* 11/2016 Crews ..... E21B 41/0035
2017/0370208 A1* 12/2017 Dawson ..... E21B 7/06
2018/0003033 A1* 1/2018 Dawson ..... E21B 43/26

FOREIGN PATENT DOCUMENTS

WO 2015108540 7/2015
WO 2015108563 7/2015
WO 2015187141 12/2015

OTHER PUBLICATIONS

Hagoort, J., Weatherill, B.D., & Settari, A., "Modeling the Propagation of Waterflood-Induced Hydraulic Fractures", SPE7412, Aug. 1980.

* cited by examiner

REAL-TIME WELL BASHING DECISION

BACKGROUND

In the oil and gas industry, a well that is not producing as expected may need stimulation to increase the production of subsurface hydrocarbon deposits, such as oil and natural gas. Hydraulic fracturing is a type of stimulation treatment that has long been used for well stimulation in unconventional reservoirs. A multistage stimulation treatment operation may involve drilling a horizontal wellbore and injecting treatment fluid into a surrounding formation in multiple stages via a series of perforations or formation entry points along a path of a wellbore through the formation. During each of the stimulation treatment, different types of fracturing fluids, proppant materials (e.g., sand), additives and/or other materials may be pumped into the formation via the entry points or perforations at high pressures to initiate and propagate fractures within the formation to a desired extent. With advancements in horizontal well drilling and multi-stage hydraulic fracturing of unconventional reservoirs, there is a greater need for ways to accurately monitor the downhole flow and distribution of injected fluids across different perforation clusters and efficiently deliver treatment fluid into the subsurface formation.

Diversion is a technique used in injection treatments to facilitate uniform distribution of treatment fluid over each stage of the treatment or within the fracture to prevent fluid loss, generate complexity or prevent well bashing. Diversion may involve the delivery of diverter material into the wellbore to divert injected treatment fluids toward formation entry points along the wellbore path that are receiving inadequate treatment. Examples of such diverter material include, but are not limited to, viscous foams, particulates, gels, benzoic acid and other chemical diverters. Traditionally, operational decisions related to the use of diversion technology for a given treatment stage, including when and how much diverter is used, are made a priori according to a predefined treatment schedule. However, conventional diversion techniques based on such predefined treatment schedules fail to account for actual operating conditions that affect the downhole flow distribution of the treatment fluid over the course of the stimulation treatment.

BRIEF DESCRIPTION OF THE DRAWINGS

Accordingly, there are disclosed in the drawings and the following description systems and related methods for controlling well bashing during stimulation treatment in a subterranean formation. In the drawings.

Figure 1:
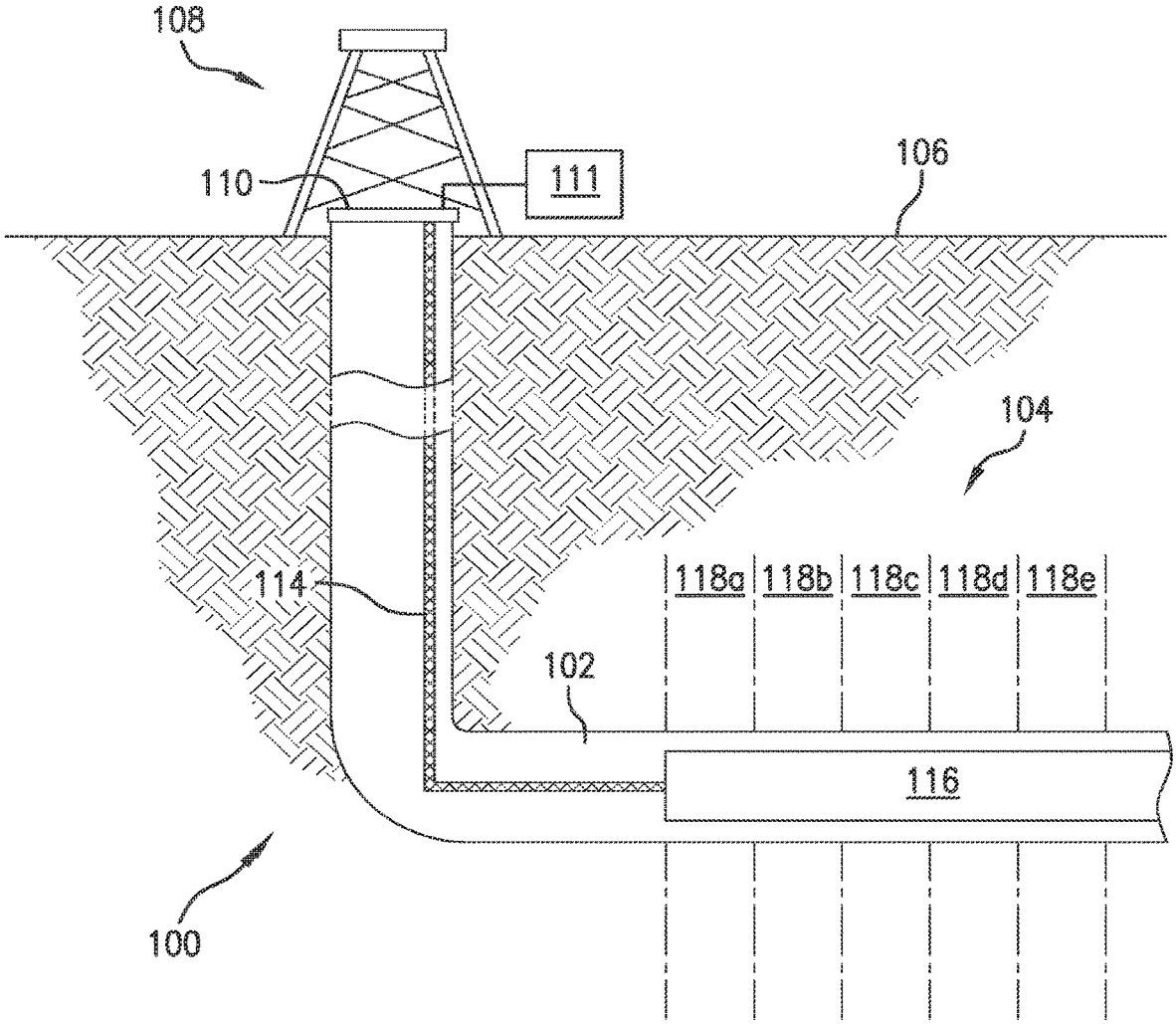
FIG. 1 is a diagram illustrating an example of a well system for performing a multistage stimulation treatment of a hydrocarbon reservoir formation.

It should be understood, however, that the specific embodiments given in the drawings and detailed description do not limit the disclosure. On the contrary, they provide the foundation for one of ordinary skill to discern the alternative forms, equivalents, and modifications that are encompassed together with one or more of the given embodiments in the scope of the appended claims.

DETAILED DESCRIPTION

Disclosed herein are systems and related methods for controlling well bashing during stimulation treatment. Particular embodiments relate to deploying diverter material in a subterranean formation to control well bashing during stimulation treatment. In at least some embodiments, a method includes applying a treatment in at least a first well of a plurality of wells in a subterranean formation. The method further includes determining a flow distribution based on at least one of a first-well measurement or a second-well measurement, wherein the first-well measurement is taken at the first well, and wherein the second-well measurement is taken at a second well of the plurality of wells. The method further includes determining a length of a fracture between the first well and the second well, based on the determined flow distribution, and determining if the applied treatment at the first well interferes with the second well, based on the determined length of the fracture. The method further includes applying a diverting material at the first well if it is determined that the applied treatment interferes with the second well, in order to control well bashing of the second well.

A related system includes at least one processor, and a memory coupled to the at least one processor having instructions stored therein. When executed by the at least one processor, the instructions cause the at least one processor to perform functions including functions to: apply a treatment in at least a first well of a plurality of wells in a subterranean formation; determine a flow distribution based on at least one of a first-well measurement or a second-well measurement, wherein the first-well measurement is taken at the first well, and wherein the second-well measurement is taken at a second well of the plurality of wells; determine a length of a fracture between the first well and the second well, based on the determined flow distribution; determine if the applied treatment at the first well interferes with the second well, based on the determined length of the fracture; and apply a diverting material at the first well if it is determined that the applied treatment interferes with the second well, in order to control well bashing of the second well.

FIG. 1 is a diagram illustrating an example of a well system 100 for performing a multistage stimulation treatment of a hydrocarbon reservoir formation. As shown in the example of FIG. 1, well system 100 includes a wellbore 102 in a subsurface formation 104 beneath a surface 106 of the wellsite. Wellbore 102 as shown in the example of FIG. 1 includes a horizontal wellbore. However, it should be appreciated that embodiments are not limited thereto and that well system 100 may include any combination of horizontal, vertical, slant, curved, and/or other wellbore orientations. The subsurface formation 104 may include a reservoir that contains hydrocarbon resources, such as oil, natural gas, and/or others. For example, the subsurface formation 104 may be a rock formation (e.g., shale, coal, sandstone, granite, and/or others) that includes hydrocarbon deposits, such as oil and natural gas. In some cases, the subsurface formation 104 may be a tight gas formation that includes low permeability rock (e.g., shale, coal, and/or others). The subsurface formation 104 may be composed of naturally fractured rock and/or natural rock formations that are not fractured to any significant degree.

Well system 100 also includes a fluid injection system 108 for injecting treatment fluid, e.g., hydraulic fracturing fluid, into the subsurface formation 104 over multiple sections 118*a*, 118*b*, 118*c*, 118*d*, and 118*e* (collectively referred to herein as "sections 118") of the wellbore 102, as will be described in further detail below. Each of the sections 118 may correspond to, for example, a different stage or interval of the multistage stimulation treatment. The boundaries of the respective sections 118 and corresponding treatment stages/intervals along the length of the wellbore 102 may be delineated by, for example, the locations of bridge plugs, packers and/or other types of equipment in the wellbore 102. Additionally or alternatively, the sections 118 and corresponding treatment stages may be delineated by particular features of the subsurface formation 104. Although five sections are shown in FIG. 1, it should be appreciated that any number of sections and/or treatment stages may be used as desired for a particular implementation. Furthermore, each of the sections 118 may have different widths or may be uniformly distributed along the wellbore 102.

As shown in FIG. 1, injection system 108 includes an injection control subsystem 111, a signaling subsystem 114 installed in the wellbore 102, and one or more injection tools 116 installed in the wellbore 102. The injection control subsystem 111 can communicate with the injection tools 116 from a surface 110 of the wellbore 102 via the signaling subsystem 114. Although not shown in FIG. 1, injection system 108 may include additional and/or different features for implementing the flow distribution monitoring and diversion control techniques disclosed herein. For example, the injection system 108 may include any number of computing subsystems, communication subsystems, pumping subsystems, monitoring subsystems, and/or other features as desired for a particular implementation. In some implementations, the injection control subsystem 111 may be communicatively coupled to a remote computing system (not shown) for exchanging information via a network for purposes of monitoring and controlling wellsite operations, including operations related to the stimulation treatment. Such a network may be, for example and without limitation, a local area network, medium area network, and/or a wide area network, e.g., the Internet.

During each stage of the stimulation treatment, the injection system 108 may alter stresses and create a multitude of fractures in the subsurface formation 104 by injecting the treatment fluid into the surrounding subsurface formation 104 via a plurality of formation entry points along a portion of the wellbore 102 (e.g., along one or more of sections 118). The fluid may be injected through any combination of one or more valves of the injection tools 116. The injection tools 116 may include numerous components including, but not limited to, valves, sliding sleeves, actuators, ports, and/or other features that communicate treatment fluid from a working string disposed within the wellbore 102 into the subsurface formation 104 via the formation entry points. The formation entry points may include, for example, open-hole sections along an uncased portion of the wellbore path, a cluster of perforations along a cased portion of the wellbore path, ports of a sliding sleeve completion device along the wellbore path, slots of a perforated liner along the wellbore path, or any combination of the foregoing.

The injection tools 116 may also be used to perform diversion in order to adjust the downhole flow distribution of the treatment fluid across the plurality of formation entry points. Thus, the flow of fluid and delivery of diverter material into the subsurface formation 104 during the stimulation treatment may be controlled by the configuration of the injection tools 116. The diverter material injected into the subsurface formation 104 may be, for example, a degradable polymer. Examples of different degradable polymer materials that may be used include, but are not limited to, polysaccharides; lignosulfonates; chitins; chitosans; proteins; proteinous materials; fatty alcohols; fatty esters; fatty acid salts; aliphatic polyesters; poly(lactides); poly(glycolides); poly(ε-caprolactones); polyoxymethylene; polyurethanes; poly(hydroxybutyrates); poly(anhydrides); aliphatic polycarbonates; polyvinyl polymers; acrylic-based polymers; poly(amino acids); poly(aspartic acid); poly(alkylene oxides); poly(ethylene oxides); polyphosphazenes; poly(orthoesters); poly(hydroxy ester ethers); polyether esters; polyester amides; polyamides; polyhydroxyalkanoates; polyethyleneterephthalates; polybutyleneterephthalates; polyethylenenaphthalenates, and copolymers, blends, derivatives, or combinations thereof. However, it should be appreciated that embodiments of the present disclosure are not intended to be limited thereto and that other types of diverter materials may also be used.

In one or more embodiments, the valves, ports, and/or other features of the injection tools 116 can be configured to control the location, rate, orientation, and/or other properties of fluid flow between the wellbore 102 and the subsurface formation 104. The injection tools 116 may include multiple tools coupled by sections of tubing, pipe, or another type of conduit. The injection tools 116 may be isolated in the wellbore 102 by packers or other devices installed in the wellbore 102.

In some implementations, the injection system 108 may be used to create or modify a complex fracture network in the subsurface formation 104 by injecting fluid into portions of the subsurface formation 104 where stress has been altered. For example, the complex fracture network may be created or modified after an initial injection treatment has altered stress by fracturing the subsurface formation 104 at multiple locations along the wellbore 102. After the initial injection treatment alters stresses in the subterranean formation, one or more valves of the injection tools 116 may be selectively opened or otherwise reconfigured to stimulate or re-stimulate specific areas of the subsurface formation 104 along one or more sections 118 of the wellbore 102, taking advantage of the altered stress state to create complex fracture networks. In some cases, the injection system 108 may inject fluid simultaneously for multiple intervals and sections 118 of wellbore 102.

The operation of the injection tools 116 may be controlled by the injection control subsystem 111. The injection control subsystem 111 may include, for example, data processing equipment, communication equipment, and/or other systems that control injection treatments applied to the subsurface formation 104 through the wellbore 102. In one or more embodiments, the injection control subsystem 111 may receive, generate, or modify a baseline treatment plan for implementing the various stages of the stimulation treatment along the path of the wellbore 102. The baseline treatment plan may specify initial parameters for the treatment fluid to be injected into the subsurface formation 104. The treatment plan may also specify a baseline pumping schedule for the treatment fluid injections and diverter deployments over each stage of the stimulation treatment.

In one or more embodiments, the injection control subsystem 111 initiates control signals to configure the injection tools 116 and/or other equipment (e.g., pump trucks, etc.) for operation based on the treatment plan. The signaling subsystem 114 as shown in FIG. 1 transmits the signals from the injection control subsystem 111 at the wellbore surface 110 to one or more of the injection tools 116 disposed in the wellbore 102. For example, the signaling subsystem 114 may transmit hydraulic control signals, electrical control signals, and/or other types of control signals. The control signals may be reformatted, reconfigured, stored, converted, retransmitted, and/or otherwise modified as needed or desired en route between the injection control subsystem 111 (and/or another source) and the injection tools 116 (and/or another destination). The signals transmitted to the injection tools 116 may control the configuration and/or operation of the injection tools. Examples of different ways to control the operation of each of the injection tools 116 include, but are not limited to, opening, closing, restricting, dilating, repositioning, reorienting, and/or otherwise manipulating one or more valves of the tool to modify the manner in which treatment fluid, proppant, or diverter is communicated into the subsurface formation 104.

It should be appreciated that the combination of injection valves of the injection tools 116 may be configured or reconfigured at any given time during the stimulation treatment. It should also be appreciated that the injection valves may be used to inject any of various treatment fluids, proppants, and/or diverter materials into the subsurface formation 104. Examples of such proppants include, but are not limited to, sand, bauxite, ceramic materials, glass materials, polymer materials, polytetrafluoroethylene materials, nut shell pieces, cured resinous particulates comprising nut shell pieces, seed shell pieces, cured resinous particulates comprising seed shell pieces, fruit pit pieces, cured resinous particulates comprising fruit pit pieces, wood, composite particulates, lightweight particulates, microsphere plastic beads, ceramic microspheres, glass microspheres, manmade fibers, cement, fly ash, carbon black powder, and combinations thereof.

In some implementations, the signaling subsystem 114 transmits a control signal to multiple injection tools, and the control signal is formatted to change the state of only one or a subset of the multiple injection tools. For example, a shared electrical or hydraulic control line may transmit a control signal to multiple injection valves, and the control signal may be formatted to selectively change the state of only one (or a subset) of the injection valves. In some cases, the pressure, amplitude, frequency, duration, and/or other properties of the control signal determine which injection tool is modified by the control signal. In some cases, the pressure, amplitude, frequency, duration, and/or other properties of the control signal determine the state of the injection tool affected by the modification.

In one or more embodiments, the injection tools 116 may include one or more sensors for collecting data relating to downhole operating conditions and formation characteristics along the wellbore 102. Such sensors may serve as real-time data sources for various types of downhole measurements and diagnostic information pertaining to each stage of the stimulation treatment. Examples of such sensors include, but are not limited to, micro-seismic sensors, tiltmeters, pressure sensors, and other types of downhole sensing equipment. The data collected downhole by such sensors may include, for example, real-time measurements and diagnostic data for monitoring the extent of fracture growth and complexity within the surrounding formation along the wellbore 102 during each stage of the stimulation treatment, e.g., corresponding to one or more sections 118.

In some implementations, the injection tools 116 may include fiber-optic sensors for collecting real-time measurements of acoustic intensity or thermal energy downhole during the stimulation treatment. For example, the fiber-optic sensors may be components of a distributed acoustic sensing (DAS), distributed strain sensing, and/or distributed temperature sensing (DTS) subsystems of the injection system 108. However, it should be appreciated that embodiments are not intended to be limited thereto and that the injection tools 116 may include any of various measurement and diagnostic tools. In some implementations, the injection tools 116 may be used to inject particle tracers, e.g., tracer slugs, into the wellbore 102 for monitoring the flow distribution based on the distribution of the injected particle tracers during the treatment. For example, such tracers may have a unique temperature profile that the DTS subsystem of the injection system 108 can be used to monitor over the course of a treatment stage.

In one or more embodiments, the signaling subsystem 114 may be used to transmit real-time measurements and diagnostic data collected downhole by one or more of the aforementioned data sources to the injection control subsystem 111 for processing at the wellbore surface 110. Thus, in the fiber-optics example above, the downhole data collected by the fiber-optic sensors may be transmitted to the injection control subsystem 111 via, for example, fiber-optic cables included within the signaling subsystem 114. The injection control subsystem 111 (or data processing components thereof) may use the downhole data that it receives via the signaling subsystem 114 to perform real-time fracture mapping and/or real-time fracturing pressure interpretation using any of various data analysis techniques for monitoring stress fields around hydraulic fractures.

The injection control subsystem 111 may use the real-time measurements and diagnostic data received from the data source(s) to monitor a downhole flow distribution of the treatment fluid injected into the plurality of formation entry points along the path of the wellbore 102 during each stage of the stimulation treatment. In one or more embodiments, such data may be used to derive qualitative and/or quantitative indicators of the downhole flow distribution for a given stage of the treatment.

One such indicator may be, for example, the amount of flow spread across the plurality of formation entry points into which the treatment fluid is injected. As used herein, the term "flow spread" refers to a measure of how far the downhole flow distribution deviates from an ideal distribution. An ideal flow distribution may be one in which there is uniform distribution or equal flow into most, if not all, of the formation entry points, depending upon local stress changes or other characteristics of the surrounding formation that may impact the flow distribution for a given treatment stage.

Another indicator of the downhole flow distribution may be the number of sufficiently stimulated formation entry points or perforation clusters resulting from the fluid injection along the wellbore 102. A formation entry point or perforation cluster may be deemed sufficiently stimulated if, for example, the volume of fluid and proppant that it has received up to a point in the treatment stage has met a threshold. The threshold may be based on, for example, predetermined design specifications of the particular treatment. While the threshold may be described herein as a single value, it should be appreciated that embodiments are not intended to be limited thereto and that the threshold may be a range of values, e.g., from a minimum threshold value to a maximum threshold value.

In one or more embodiments, the above-described indicators of downhole flow distribution may be derived by the injection control subsystem 111 by performing a qualitative and/or quantitative analysis of the real-time measurements and diagnostic data to determine the flow spread and stimulated cluster parameters. The type of analysis performed by the injection control subsystem 111 for determining the flow spread and number of sufficiently stimulated entry points or perforation clusters may be dependent upon the types of measurements and diagnostics (and data sources) that are available during the treatment stage.

For example, the injection control subsystem 111 may determine such parameters based on a qualitative analysis of real-time measurements of acoustic intensity or temporal heat collected by fiber-optic sensors disposed within the wellbore 102 as described above. Alternatively, the injection control subsystem 111 may perform a quantitative analysis using the data received from the fiber-optic sensors. The quantitative analysis may involve, for example, assigning flow percentages to each formation entry point or perforation cluster based on acoustic and/or thermal energy data accumulated for each entry point or cluster and then using the assigned flow percentages to calculate a corresponding coefficient representing the variation of the fluid volume distribution across the formation entry points.

In another example, the injection control subsystem 111 may determine the flow spread and/or number of sufficiently stimulated entry points by performing a quantitative analysis of real-time micro-seismic data collected by downhole micro-seismic sensors, e.g., as included within the injection tools 116. The micro-seismic sensors may be, for example, geophones located in a nearby wellbore, which may be used to measure microseismic events within the surrounding subsurface formation 104 along the path of the wellbore 102. The quantitative analysis may be based on, for example, the location and intensity of micro-seismic activity. Such activity may include different micro-seismic events that may affect fracture growth within the subsurface formation 104. In one or more embodiments, the length and height of a fracture may be estimated based on upward and downward growth curves generated by the injection control subsystem 111 using the micro-seismic data from the micro-seismic sensors. Such growth curves may in turn be used to estimate a surface area of the fracture. The fracture's surface area may then be used to compute the volume distribution and flow spread.

In yet another example, the injection control subsystem 111 may use real-time pressure measurements obtained from downhole and surface pressure sensors to perform real-time pressure diagnostics and analysis. The results of the analysis may then be used to determine the downhole flow distribution indicators, i.e., the flow spread and number of sufficiently stimulated formation entry points, as described above. The injection control subsystem 111 in this example may perform an analysis of surface treating pressure as well as friction analysis and/or other pressure diagnostic techniques to obtain a quantitative measure of the flow spread and number of sufficiently simulated entry points.

In a further example, the injection control subsystem 111 may use real-time data from one or more tiltmeters to infer fracture geometry through fracture induced rock deformation during each stage of the stimulation treatment. The tiltmeters in this example may include surface tiltmeters, downhole tiltmeters, or a combination thereof. The measurements acquired by the tiltmeters may be used to perform a quantitative evaluation of the flow spread and sufficiently stimulated formation entry points during each stage of the stimulation treatment.

It should be noted that the various analysis techniques in the examples above are provided for illustrative purposes only and that embodiments of the present disclosure are not intended to be limited thereto. The disclosed embodiments may be applied to other types of wellsite data, data sources, and analysis or diagnostic techniques for determining the downhole flow distribution or indications thereof. It should also be noted that each of the above described analysis techniques may be used independently or combined with one or more other techniques. In some implementations, the analysis for determining the flow spread and number of sufficiently stimulated entry points may include applying real-time measurements obtained from one or more of the above-described sources to an auxiliary flow distribution model. For example, real-time measurements collected by the data source(s) during a current stage of the stimulation treatment may be applied to a geomechanics model of the subsurface formation 104 to simulate flow distribution along the wellbore 102. The results of the simulation may then be used to determine a quantitative measure of the flow spread and number of sufficiently stimulated formation entry points over a remaining portion of the current stage to be performed.

As will be described in further detail below, the injection control subsystem 111 may use real-time measurement data (e.g., data measured by sensors of injection system 108) to make real-time adjustments to the baseline treatment plan. For example, measurement data from a particular wellbore may be used to make real-time operational decisions in order to slow or prevent (or reduce the likelihood of) well bashing during stimulation treatment. The term "well bashing" refers to a phenomenon in which there is cross-communication between wells during stimulation or drilling which could result in affecting production in the offset well. During one example of well bashing, treatment fluid that is applied at one wellbore affects the level of production at another wellbore. This may occur, for example, when the applied treatment fluid reaches the other wellbore via one or more fractures. During pad drilling, multiple wells are drilled on a pad or lease to maximize the drainage of the lease. An inadvertent delivery of treatment fluids into an adjacent well may damage production from offset wells and lead to inadequate drainage of the reservoir.

As mentioned above, real-time measurement data from a particular wellbore may be used to slow or prevent the occurrence of well bashing. The potential target of the well bashing may be another wellbore (e.g., a different wellbore that is adjacent to or in the vicinity of the wellbore), or the potential target may be the wellbore itself. Real-time adjustments to the baseline treatment schedule may be used to control diverter deployments over the course of a treatment stage. For example, the baseline treatment schedule may be adjusted in real-time such that a diverter deployment for a particular stage (e.g., a previously unplanned diverter deployment for that stage) is performed. In this manner, stimulation treatment fluid can be diverted (e.g., to other areas or locations), in order to prevent or slow the occurrence of well bashing. The injection control subsystem 111 may initiate additional control signals to reconfigure the injection tools 116 based on the adjusted treatment plan.

In one or more embodiments, the flow of an applied stimulation treatment is monitored, in order to determine whether diverting of the treatment is performed. For example, a quantitative or qualitative measurement of flow into one wellbore is determined, in order to determine if the treatment is bashing another well. In one or more embodiments, a downhole flow distribution may be used to determine whether or not a diverter deployment is performed.

In one or more embodiments, the determination of whether or not to deploy the diverter material may be made at some predefined point during the implementation of the stage along the wellbore 102. Examples of such a "determination point" include, but are not limited to, the end of the pad stage or the end of the first low concentration proppant ramp. The determination point may be selected prior to the beginning of the treatment stage.

In at least one embodiment, real-time measurement data of a well that is not being stimulated (e.g., via injection of treatment fluid) is used to determine whether a diverter deployment is performed. This will be described in more detail with reference to FIG. 2.

Figure 2:
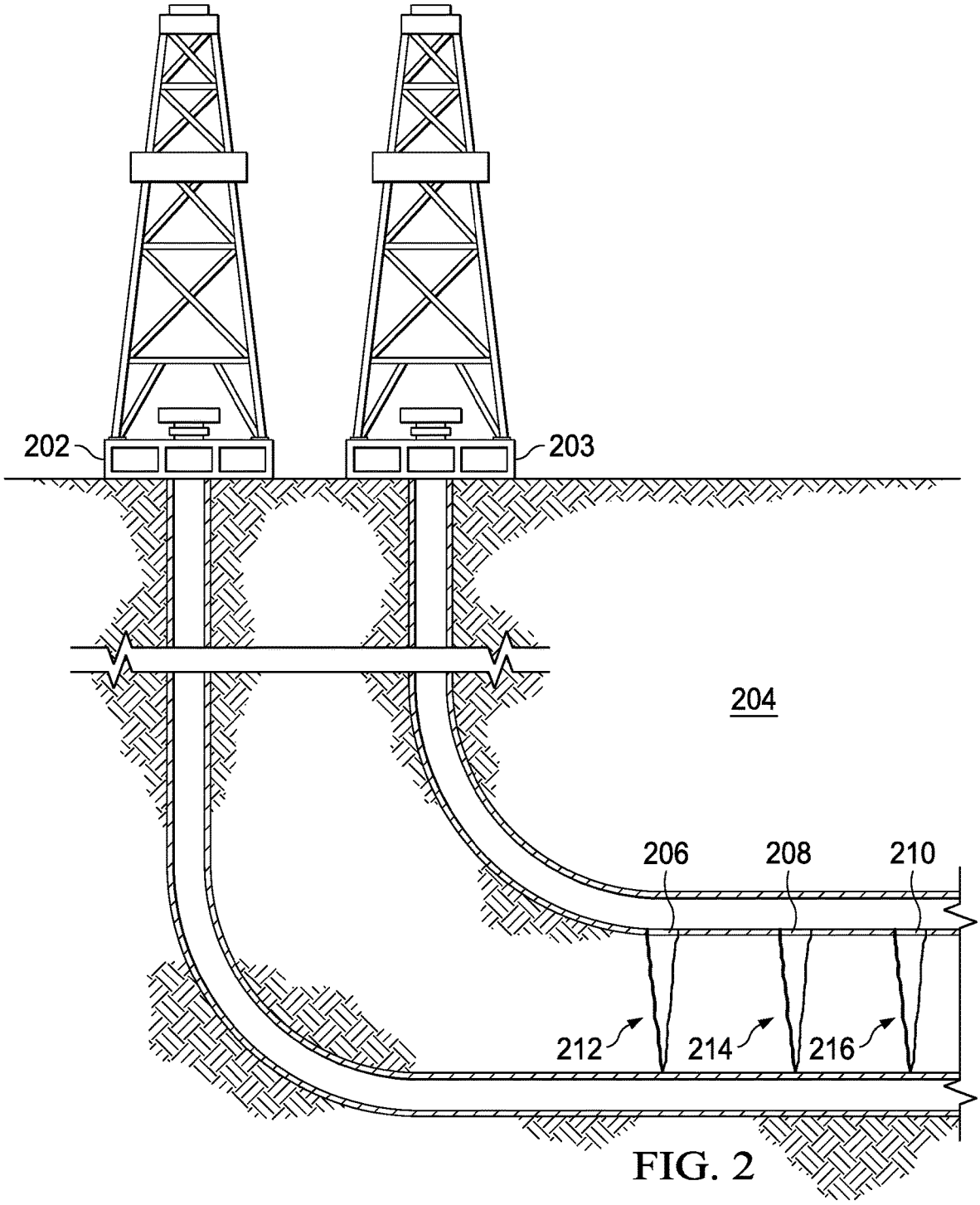
FIG. 2 illustrates an illustrative scenario in which real-time measurement data of a well that is not being stimulated is used.

FIG. 2 illustrates an illustrative scenario. Wellbore 202 and wellbore 203 are formed in a subsurface formation 204. For purposes of simplicity, only two wellbores are depicted in the illustration of FIG. 2. However, it is understood that additional wellbores may be formed in the formation 204. For example, the wellbores 202 and 203 may be part of more than two wells that are formed in the formation 204 (e.g., more than two wells that are formed in the same pad).

In at least one embodiment, a multistage stimulation treatment of the formation 204 is performed at wellbore 203. For example, the multistage stimulation treatment is of the type that was described earlier with reference to wellbore 102 of FIG. 1. Fractures in the formation 204 may be caused by injecting treatment fluid into the surrounding areas of the formation at the wellbore 203. For example, such fractures in the formation 204 may lead from perforation clusters 206, 208, and/or 210 of wellbore 203. As illustrated in FIG. 2, such fractures may be located at areas 212, 214, and/or 216 of the formation 204.

In some situations, the injected treatment fluid may interfere with production at one or more other wells (e.g., wellbores that are adjacent to or in the vicinity of wellbore 203). In at least one embodiment, it is determined that the injected treatment fluid may interfere with production at wellbore 202 if, for example, the length of a fracture in areas 212, 214, and/or 216 exceeds a particular threshold. In at least one embodiment, the threshold is approximately equal to a known distance (or separation) between wellbores 202 and 203.

In at least one embodiment, length(s) of one or more of such fracture(s) are estimated, and then compared against the threshold. The lengths may be estimated based on the flow distribution of the injected treatment fluid into various areas (e.g., clusters 206, 208, and/or 210) of a wellbore that is being treated (e.g., wellbore 203).

In at least one embodiment, the flow distribution is estimated based on real-time measurements of one or more other wells (e.g., wellbore 202). The real-time measurements may correspond to locations (e.g., depths or formation entry points) of the wellbore 202 that are proximate to (e.g., opposite) the clusters 206, 208, and/or 210. In at least one embodiment, the real-time measurements are obtained from fiber-optic sensors disposed within the wellbore 202. For example, the fiber-optic sensors may be coupled to at least one of a drill string, a coiled tubing string, tubing, a casing, a wireline, or a slickline disposed within the wellbore 202.

Fiber-optic sensors may be used to collect real-time measurements of acoustic intensity of wellbore 202, concurrent with the stimulation treatment of the wellbore 203. For example, during stimulation of the wellbore 203, the acoustic intensity is detected by one or more fiber-optic sensors in the wellbore 202. The collected measurements may then be communicated to the surface (e.g., via fiber-optic cable to injection control subsystem 111) for determination of the flow distribution into the different clusters of wellbore 203.

The determined flow distribution can be used together with information regarding the stimulation flow rate to determine the respective volumes of injection fluid that are entering the clusters 206, 208, and/or 210. As will be described later with reference to FIG. 3 with respect to one or more embodiments, the determined volumes can then be used to determine the lengths of fractures leading from the clusters. For example, the determined volume that is entering cluster 206 can be used to determine the length of a fracture in area 212 leading from the cluster 206. As another example, the determined volume that is entering cluster 208 can be used to determine the length of a fracture in area 214 leading from the cluster 208. As another example, the determined volume entering cluster 210 can be used to determine the length of a fracture in area 216 leading from the cluster 210.

The distance (or separation) between the wellbores 202 and 203 may be known. For example, the distance between the wellbores 202 and 203 in the vicinity (or general area) of the clusters 206, 208, and 210 is known. After the length of one or more fractures (e.g., in areas 212, 214, and/or 216) is determined, the determined length is compared against the known distance between the wellbores 202 and 203. In at least one embodiment, if the determined length is at least sufficiently close to the known distance, then it is determined that the stimulation of the wellbore 203 may interfere with production at the wellbore 202, and a decision is made to perform a diverter deployment at the wellbore 203. The deployment of the diverter serves to divert the flow of the injection fluid, in order to slow or prevent well bashing and/or to induce additional complexity in the drainage area.

As described earlier with respect to at least one embodiment, real-time measurements of acoustic intensity (e.g., as collected by fiber-optic sensors) are used to determine the flow distribution into different clusters of a particular wellbore (e.g., wellbore 203). According to at least one embodiment, real-time measurements of acoustic intensity that are collected by fiber-optics sensors at wellbore 202 are used. According to one or more other embodiments, other types of measurements are used. For example, measurements of thermal energy may be used. Accordingly, fiber-optics sensors may be components of a distributed strain sensing system (or subsystem), and/or a DTS system (or subsystem). A qualitative assessment can be made based on a real-time acoustic intensity or temporal heat map. Alternatively, or in addition, a quantitative assessment can be made by assigning flow percentages using accumulated acoustic energy or thermal energy for each cluster and computing, for example, the coefficient of variation of the fluid volume distribution.

It is understood that real-time measurements may be obtained from data sources other than (or in addition to) fiber-optic sensors. As described earlier with reference to FIG. 1, such other data sources may include, but are not limited to, micro-seismic sensors, pressure sensors, and tiltmeters. Regarding micro-seismic sensors, a quantitative assessment is based on location and intensity of micro-seismic activity. Based on real-time micro-seismic events, fracture length and height are estimated based on upward and downward growth curves, which in turn are used to compute an estimate for the surface area of each fracture. The fracture surface area is then used to compute the volume distribution. Regarding pressure sensors, a quantitative assessment may be based on analysis of surface treating pressure, as well as friction analysis/diagnostic techniques, e.g., from a treated wellbore or a different wellbore adjacent to the treated wellbore.

In at least one embodiment, real-time measurement data of a well that is being stimulated is used to determine whether a diverter deployment is performed. This will be described in more detail with reference to FIG. 3.

Figure 3:
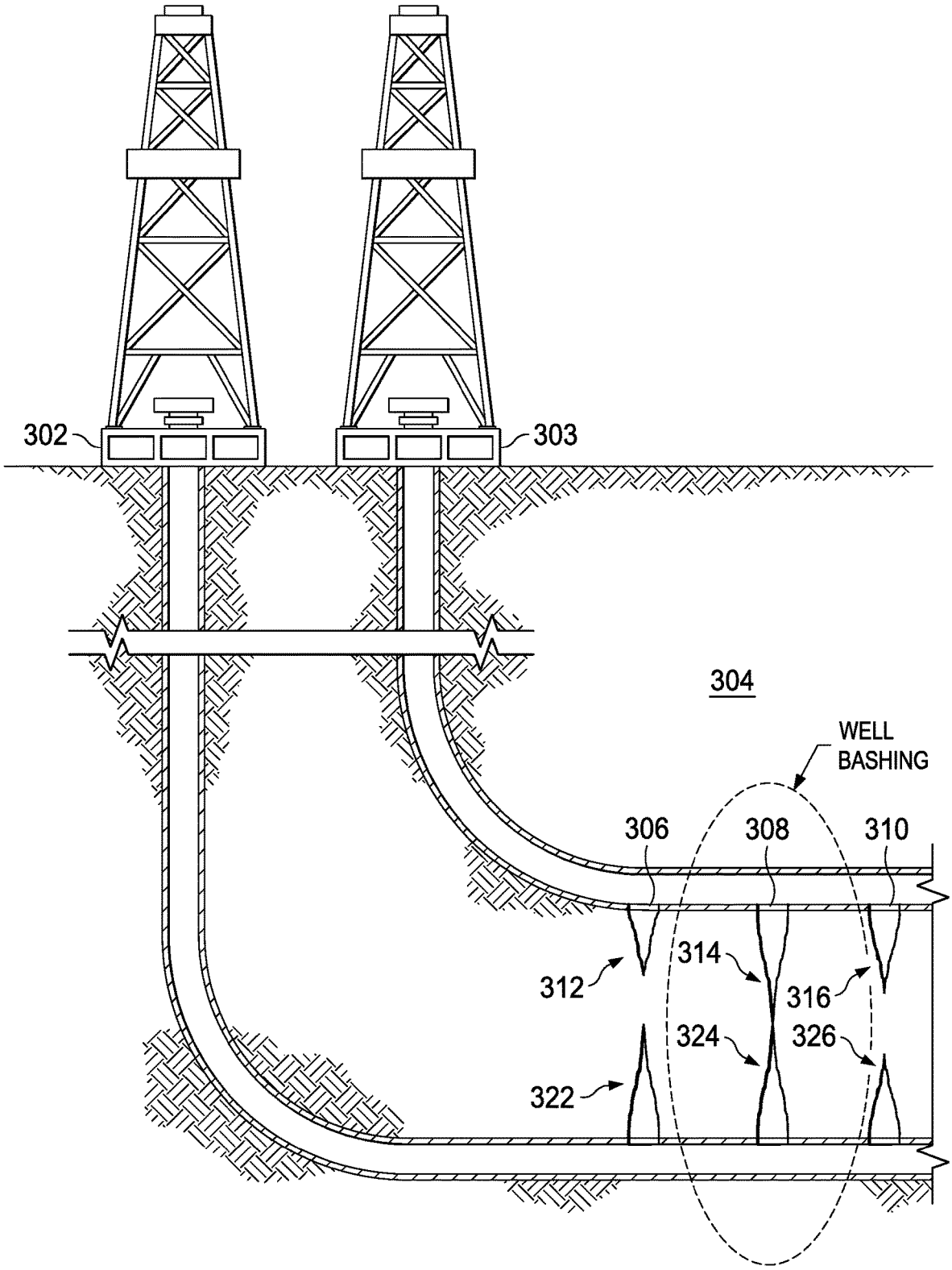
FIG. 3 illustrates an illustrative scenario in which real-time measurement data of a well that is being stimulated is used.

FIG. 3 illustrates an illustrative scenario. Wellbore 302 and wellbore 303 are formed in a subsurface formation 304. For purposes of simplicity, only two wellbores are depicted in the illustration of FIG. 3. However, it is understood that additional wellbores may be formed in the formation 304. For example, the wellbores 302 and 303 may be part of more than two wells formed in the formation 304 (e.g., more than two wells that are formed in the same pad).

In at least one embodiment, a multistage stimulation treatment of the formation 304 is performed at wellbore 302. Concurrently (e.g., at the same time), a multistage stimulation treatment of the formation 304 is performed at wellbore 303. The multistage stimulation treatments may be of the type that was described earlier with reference to wellbore 102 of FIG. 1. Regarding wellbore 303, fractures in the formation 304 may be caused by injecting treatment fluid into the surrounding areas of the formation at the wellbore 303. For example, fractures in the formation 304 may lead from perforation clusters 306, 308, and/or 310 of wellbore 303. As illustrated in FIG. 3, fractures may be located at areas 312, 314, and/or 316.

Regarding wellbore 302, the formation of fractures may be caused in a similar manner. For example, as illustrated in FIG. 3, fractures may be located at areas 322, 324, and/or 326.

In some situations, the injected treatment fluid at wellbore 302 and/or wellbore 303 may interfere with production at wellbore 303 and/or wellbore 302. (In addition, the injected treatment fluid may interfere with production at wellbores in formation 304 that are not explicitly illustrated in FIG. 3.) In at least one embodiment, it is determined that such interference may occur if, for example, the sum of (1) a length of one or more fractures in area 314 and (2) a length of one or more fractures in area 324 exceeds a particular threshold. In at least one embodiment, the threshold is approximately equal to a known distance (or separation) between wellbores 302 and 303. Also, in at least one embodiment, it is determined that such interference may occur if, for example, the sum of (1) a length of one or more fractures in area 312 and (2) a length of one or more fractures in area 322 exceeds the threshold. Also, in at least one embodiment, it is determined that such interference may occur if, for example, the sum of (1) a length of one or more fractures in area 316 and (2) a length of one or more fractures in area 326 exceeds the threshold.

In at least one embodiment, lengths of fractures are estimated, and the sum of the estimated lengths is compared against the threshold. The lengths of fractures extending from a particular wellbore (e.g., wellbore 303) may be estimated based on a flow distribution of injected treatment fluid into various areas of wellbore (e.g., the flow distribution into clusters 306, 308, and/or 310).

In at least one embodiment, the flow distribution at one wellbore (e.g., wellbore 303 or 302) is estimated based on real-time measurements at one or more other wellbores (e.g., wellbore 302 or wellbore 303). For purposes of brevity, the estimation of the fracture lengths and the estimation of the flow distribution will be described with reference to real-time measurements of acoustic intensity. For example, the real-time measurements will be described as being collected by fiber-optic sensors. However, it is understood that the real-time measurements may be measurements of other types (e.g., thermal energy), as described earlier with reference to FIG. 2. In addition, it is understood that the real-time measurements may be obtained from data sources (e.g., tiltmeters, pressure sensors, etc.) in addition to or other than fiber-optic sensors, as also described earlier with reference to FIGS. 1 and 2.

In at least one embodiment, real-time measurements of acoustic intensity are obtained from fiber-optic sensors disposed within the wellbore 302 at locations (e.g., depths or formation entry points) that are proximate to the clusters 306, 308, and/or 310. In at least one embodiment, the real-time measurements are obtained from fiber-optic sensors disposed within the wellbore 302. For example, the fiber-optic sensors may be coupled to at least one of a drill string, a coiled tubing string, tubing, a casing, a wireline, or a slickline disposed within the wellbore 302.

The determined flow distribution can be used together with information regarding the stimulation flow rate of wellbore 303 to determine the volumes of injection fluid that are entering the clusters 306, 308, and/or 310. The determined volumes can then be used to determine the lengths of fractures leading from the clusters. In at least one embodiment, Equation (1) below is used to determine the length of a particular fracture.

$$V_{fp} = \frac{\sqrt{\pi}\,(1-v^2)hK_{IC}}{2E}L_f^{3/2} \tag{1}$$

In Equation (1) above, $V_{fp}$ denotes the fracture volume, E denotes Young's modulus, h denotes the fracture height, $K_{IC}$ denotes the Stress intensity factor, v denotes Poisson's ratio, and $L_f$ denotes the fracture length.

Using Equation (1), the lengths of fractures leading from the clusters can be determined. For example, the determined volume that is entering cluster 306 can be used to determine the length of a fracture in area 312 leading from the cluster 306. As another example, the determined volume that is entering cluster 308 can be used to determine the length of a fracture in area 314 leading from the cluster 308. As another example, the determined volume entering cluster 310 can be used to determine the length of a fracture in area 316 leading from the cluster 310.

In a similar manner, the lengths of fractures caused by the stimulation treatment of wellbore 302 can be determined. For example, the lengths of fractures located in areas 322, 324, and/or 326 are determined based on real-time measurements of acoustic intensity that are collected by fiber-optic sensors disposed within the wellbore 303.

In at least one embodiment, the distance (or separation) between the wellbores 302 and 303 is known. For example, the distance between the wellbores 302 and 303 in the vicinity of the clusters 306, 308, and 310 are known. After the lengths of fractures (e.g., one or more fractures in areas 312, 314, and/or 316, and one or more fractures in areas 322, 324, and/or 326) are determined, the sum of lengths of corresponding fractures is determined. In at least one embodiment, the sum of a length of a fracture in area 312 and a length of a fracture in area 322 is determined. Similarly, the sum of a length of a fracture in area 314 and a length of a fracture in area 324 is determined. Similarly, the sum of a length of a fracture in area 316 and a length of a fracture in area 326 is determined.

The sums are compared against the known distance between the wellbores 302 and 303. In at least one embodiment, if the sum is at least sufficiently close to the known distance, then it is determined that the stimulation of the wellbore 303 may interfere with production at the wellbore 302, and a decision is made to perform a diverter deployment at the wellbore 303. Alternatively (or in addition), if the sum is at least sufficiently close to the known distance, then it is determined that the stimulation of the wellbore 302 may interfere with production at the wellbore 303, and a decision is made to perform a diverter deployment at the wellbore 302.

As illustrated in the scenario of FIG. 3, a fracture in area 314 meets a corresponding fracture in area 324. In such a situation, it is expected that the sum of the lengths of the two fractures is sufficiently close to the known distance between the wellbore 302 and 303. Deployment of a diverter at wellbore 302 and/or deployment of a diverter at wellbore 303 serves to divert the flow of the injection fluid, in order to slow or prevent well bashing and/or to induce complexity in the drainage area.

Figure 4:
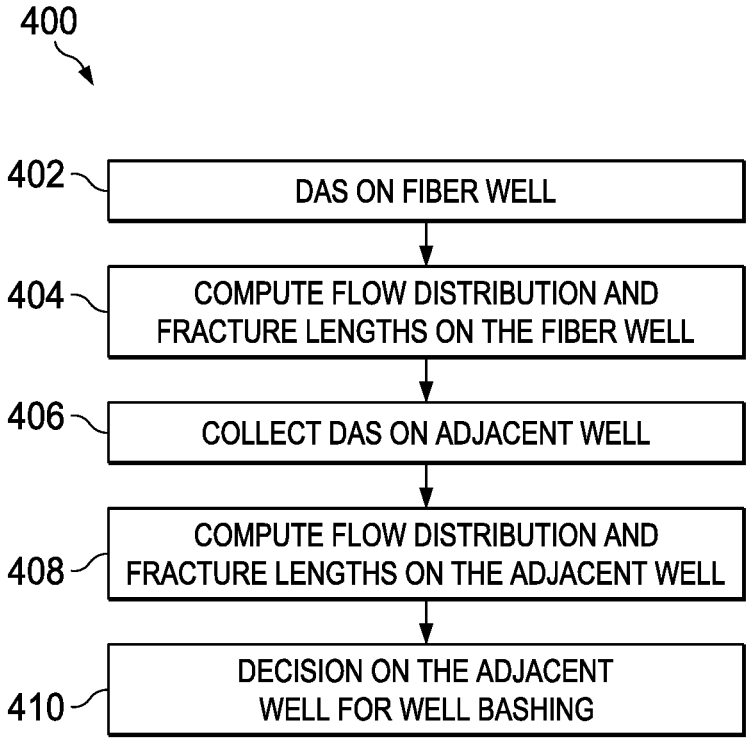
FIG. 4 is a flowchart of an illustrative process for real-time monitoring and controlling well bashing using diversion techniques during stimulation treatments.

FIG. 4 is a flowchart of an illustrative process 400 for real-time monitoring and controlling well bashing using diversion techniques during stimulation treatments. For discussion purposes, process 400 will be described using well system 100 of FIG. 1 and the scenario of FIG. 3, as described above. However, process 400 is not intended to be limited thereto. The stimulation treatment in this example is assumed to be a multistage stimulation treatment, e.g., a multistage hydraulic fracturing treatment, in which each stage of the treatment is conducted along a portion of a wellbore path (e.g., one or more sections 118 along the wellbore 102 of FIG. 1, the wellbore 302, and the wellbore 303 of FIG. 3, as described above). As will be described in further detail below, process 400 may be used to monitor and control the occurrence of well bashing using diversion techniques in real-time during each stage of the stimulation treatment along a planned trajectory of horizontal wellbore (e.g., wellbore 102 of FIG. 1, wellbore 302, and the wellbore 303 of FIG. 3, as described above) within a subsurface formation. The subsurface formation may be, for example, tight sand, shale, or other type of rock formation with trapped deposits of unconventional hydrocarbon resources, e.g., oil and/or natural gas. The subsurface formation or portion thereof may be targeted as part of a treatment plan for stimulating the production of such resources from the rock formation. Accordingly, process 400 may be used to appropriately adjust the treatment plan in real-time so as to slow or prevent well bashing and/or to induce complexity in the drainage area over each stage of the stimulation treatment.

At block 402, real-time measurements are collected from a first wellbore. For example, with reference back to FIG. 3, real-time measurements are collected from wellbore 302. In at least one embodiment, the real-time measurements are of acoustic intensity. In at least embodiment, the acoustic intensity measurements are collected by fiber-optic sensors that are disposed in the first wellbore.

At block 404, a flow distribution and a length of one or more fractures are determined. For example, with reference back to FIG. 3, a flow distribution of injected treatment fluid at wellbore 303 is determined. In at least one embodiment, the flow distribution is determined based on the real-time measurements that were collected at block 402. With continued reference back to FIG. 3, the lengths of one or more fractures leading from clusters 306, 308, and/or 310 are determined. In at least one embodiment, the lengths are determined based on the determined flow distribution.

At block 406, real-time measurements are collected from a second wellbore. For example, with reference back to FIG. 3, real-time measurements are collected from wellbore 303. In at least one embodiment, the second well is adjacent to the first well that was referenced earlier with respect to block 402. In at least one embodiment, the real-time measurements are of acoustic intensity. In at least embodiment, the acoustic intensity measurements are collected by fiber-optic sensors that are disposed in the second wellbore.

At block 408, a flow distribution and a length of one or more fractures are determined. For example, with reference back to FIG. 3, a flow distribution of injected treatment fluid at wellbore 302 is determined. In at least one embodiment, the flow distribution is determined based on the real-time measurements that were collected at block 406. With continued reference back to FIG. 3, the lengths of one or more fractures in areas 322, 324, and/or 326 are determined. In at least one embodiment, the lengths are determined based on the determined flow distribution.

At block 410, it is determined whether the first wellbore is bashing the second wellbore, and/or the second wellbore is bashing the first wellbore. In at least one embodiment, the sum of a length of a fracture extending from the first wellbore and a length of a fracture extending from the second wellbore is determined. The sum of the lengths is compared against a known distance between the first and second wellbores. If the sum is sufficiently close to the known distance (see, for example, the respective fractures in areas 314 and 324, as illustrated in FIG. 3), then a diverter deployment is performed at the first wellbore and/or a diverter deployment is performed at the second wellbore. The diverter deployment is performed to prevent or slow the well bashing of one wellbore by another. Even if well bashing is not occurring, then the diverter deployment is performed t induce some level of complexity, in order to increase (e.g., maximize) reservoir coverage.

Figure 5:
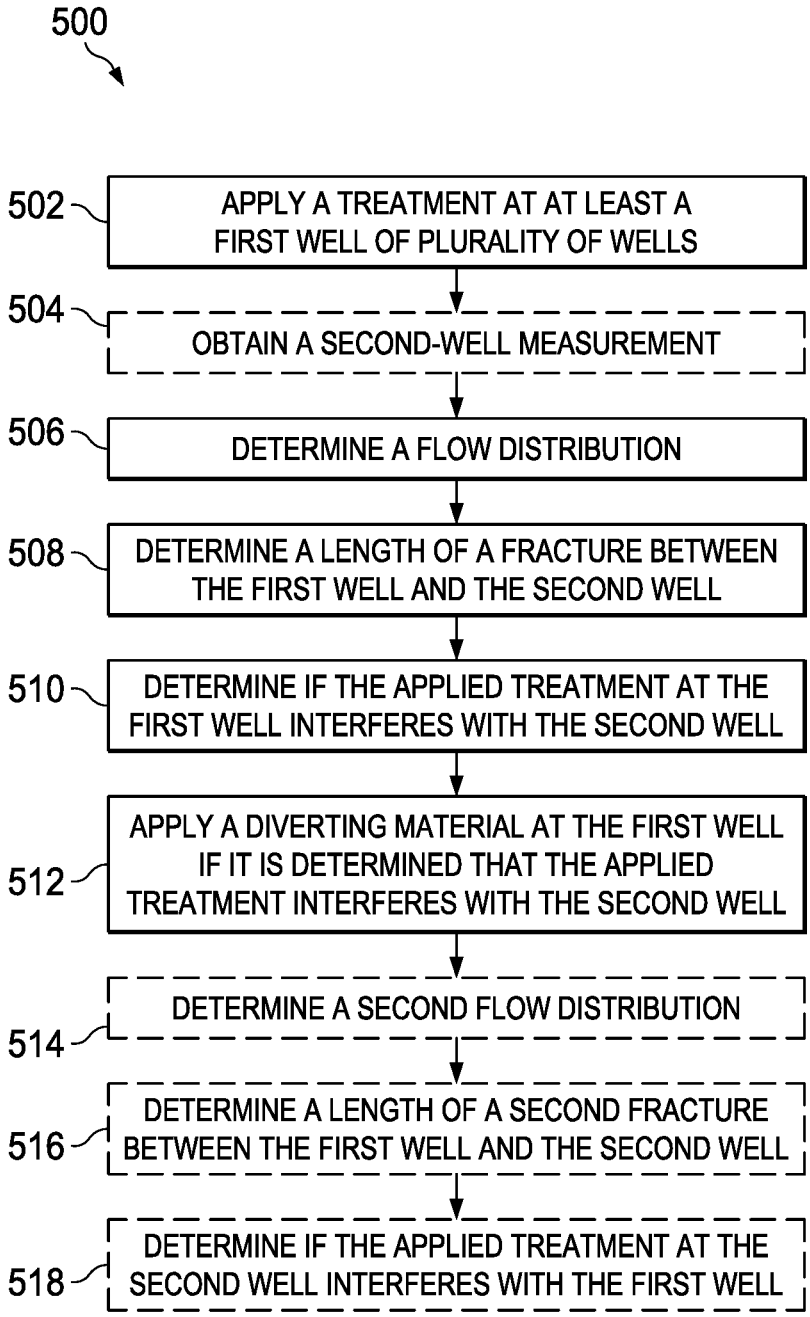
FIG. 5 shows a flowchart of an illustrative method for controlling well bashing during stimulation treatment.

FIG. 5 shows a flowchart of an illustrative method 500 for controlling well bashing during stimulation treatment, according to one or more embodiments.

At block 502, a treatment is applied in at least a first well of a plurality of wells in a subterranean formation. For example, with reference back to FIG. 2, a treatment is applied at wellbore 203. As another example, with reference back to FIG. 3, a treatment is applied at wellbore 303. In at least one embodiment, the treatment is for stimulating production.

At block 504, a second-well measurement may be obtained, concurrent with applying the treatment at the first well. For example, with reference back to FIG. 2, a real-time measurement of wellbore 202 is obtained, concurrent with application of the treatment at wellbore 203. As another example, with reference back to FIG. 3, a real-time measurement of wellbore 302 is obtained, concurrent with application of the treatment at wellbore 303.

At block 506, a flow distribution is determined. The determination is based on at least one of a first-well measurement taken at the first well or a second-well measurement taken at a second well (e.g., the second-well measurement obtained at block 504). For example, with reference back to FIG. 2, a flow distribution across clusters 206, 208, 210 is determined based on at least a real-time measurement of wellbore 202. As another example, with reference back to FIG. 3, a flow distribution across clusters 306, 308, 310 is determined based on at least a real-time measurement of wellbore 302. As yet another example, also with reference back to FIG. 3, a flow distribution across areas 322, 324, 326 is determined based on at least a real-time measurement of wellbore 303.

At block 508, a length of a fracture between the first well and the second well is determined, based on the determined flow distribution. For example, with reference back to FIG. 2, a length of a fracture leading from cluster 206 into area 212 is determined, based on the flow distribution across clusters 206, 208 and 210. As another example, with reference back to FIG. 3, a length of a fracture leading from cluster 308 into area 314 is determined, based on the flow distribution across clusters 306, 308 and 310.

At block 510, it is determined if the applied treatment at the first well interferes with the second well, based on the determined length of the fracture. For example, with reference back to FIG. 2, it is determined if the applied treatment at wellbore 203 interferes with the wellbore 202. As another example, with reference back to FIG. 3, it is determined if the applied treatment at wellbore 303 interferes with the wellbore 302.

The second well may be adjacent to the first well (see, e.g., the scenario(s) illustrated in FIG. 2 and/or FIG. 3). For example, the second well and the first well may be near each other in the same pad. Determining if the applied treatment at the first well interferes with the second well may include comparing the determined length of the fracture with a known distance between the first well and the second well. For example, with reference to FIG. 2, the determined length of the fracture may be compared with a known distance between wellbore 202 and wellbore 203. For example, with reference to FIG. 3, the determined length of the fracture may be compared with a known distance between wellbore 302 and wellbore 303.

At block 512, a diverting material is applied at the first well if it is determined that the applied treatment interferes with the second well, in order to control well bashing of the second well. For example, with reference back to FIG. 2, a diverting material is applied at wellbore 203 if it is determined that the applied treatment interferes with wellbore 202. As another example, with reference back to FIG. 3, a diverting material is applied at wellbore 303 if it is determined that the applied treatment interferes with wellbore 302.

Applying the treatment to at least the first well (see, e.g., block 502) may also include applying the treatment at the second well (e.g., wellbore 202 of FIG. 2, or wellbore 302 of FIG. 3).

Further, applying the treatment may also include applying the treatment at a third well. In this situation, the application of the treatment at the first well may occur concurrent with the application of the treatment at the third well.

Alternatively, the first well is treated either before or after the third well is treated.

In at least one embodiment, four or more wells may be formed in one pad. The treatment may be applied in three of the wells, while real-time measurements of a fourth well are obtained. Alternatively, the treatment may be applied in all four of the wells, while real-time measurements of the fourth well are obtained. In this situation, real-time measurements may be obtained from all four of the wells, or from only a subset of the wells.

If two or more wells are treated concurrently, the treatments may occur at corresponding (e.g., nearby) stages of the wells. For example, assuming that each well has a structure similar to the structure of wellbore 102 of FIG. 1, the treatments may occur at first stages (e.g., stage 118*a*) of the wells. Alternatively, the treatments may occur at stages of the wells that are different from each other. For example, assuming again that each well has a structure similar to that of wellbore 102, treatment of stage 118*a* of one well may occur concurrent with treatment of stage 118*e* of another well.

If the treatment is also applied at the second well, at block 514, a second flow distribution may be determined, based on at least one of the first-well measurement or the second-well measurement. For example, with reference back to FIG. 3, a flow distribution across areas 322, 324, 326 is determined based on at least a real-time measurement of wellbore 303.

At block 516, a length of a second fracture between the first well and the second well is determined, based on the determined second flow distribution. For example, with reference back to FIG. 3, a length of a fracture leading from wellbore 302 into area 324 is determined, based on the flow distribution across areas 322, 324, and 326.

At block 518, it is determined if the applied treatment at the second well interferes with the first well, based on the determined length of the second fracture. For example, with reference back to FIG. 3, it is determined if the applied treatment at wellbore 302 interferes with wellbore 303, based on the determined length of the second fracture.

Determining if the applied treatment at the second well interferes with the first well may include comparing a sum of the determined length of the fracture and the determined length of the second fracture, with a known distance between the first well and the second well. Alternatively, or in addition, determining if the applied treatment at the first well interferes with the second well may include comparing the sum of the determined length of the fracture and the determined length of the second fracture, with the known distance between the first well and the second well. For example, with reference back to FIG. 3, determining if the applied treatment at wellbore 302/303 interferes with wellbore 303/302 may include comparing a sum of the length of the fracture in area 314 and the length of the fracture in area 324, with a known distance between wellbores 302 and 303.

Figure 6:
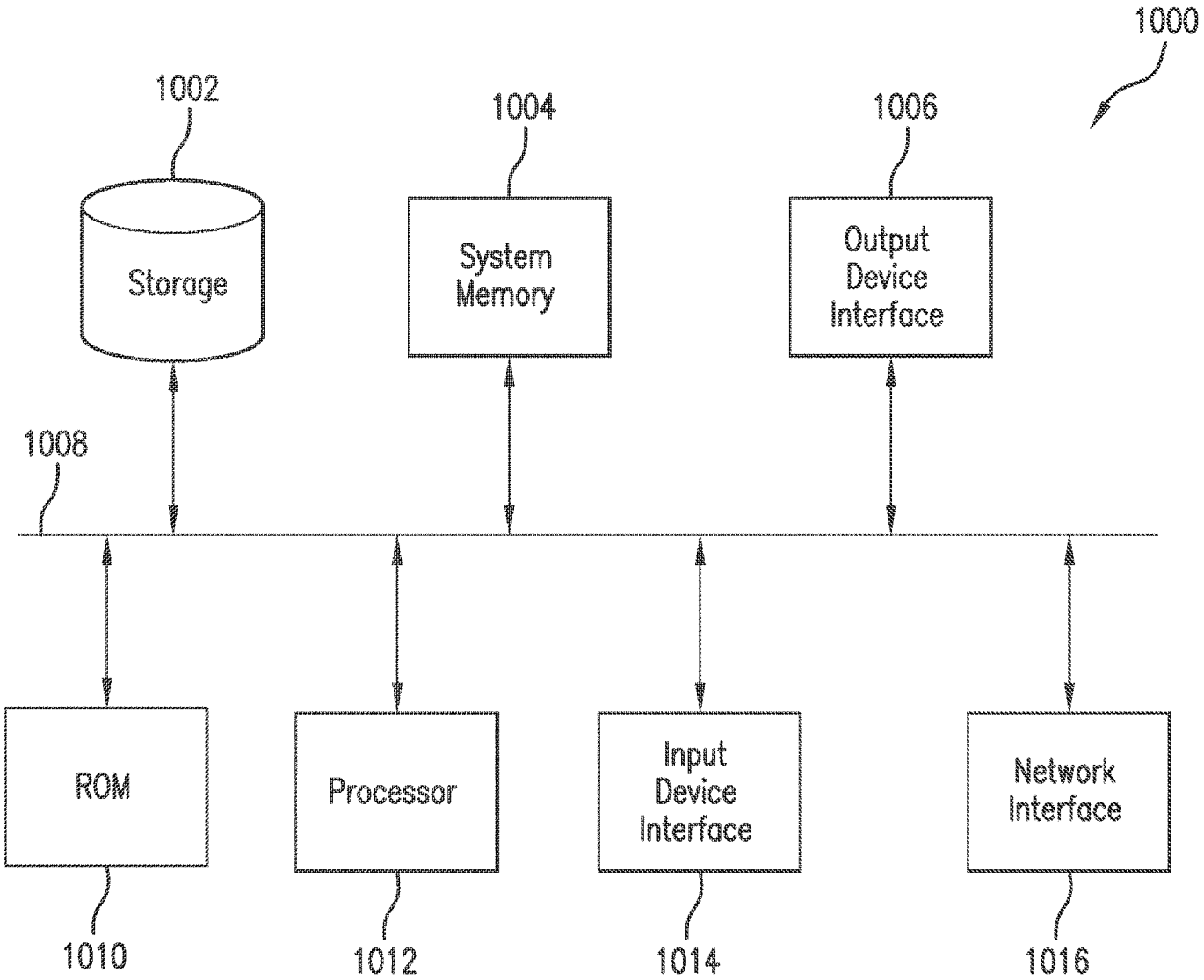
FIG. 6 is a block diagram of an exemplary computer system in which embodiments of the present disclosure may be implemented.

FIG. 6 is a block diagram of an exemplary computer system 1000 in which embodiments of the present disclosure may be implemented. For example, the injection control subsystem 111 (or data processing components thereof) of FIG. 1 and the steps of processes 400 and 500 of FIGS. 4 and 5, respectively, as described above, may be implemented using system 1000. System 1000 can be a computer, phone, PDA, or any other type of electronic device. Such an electronic device includes various types of computer readable media and interfaces for various other types of computer readable media. As shown in FIG. 6, system 1000 includes a permanent storage device 1002, a system memory 1004, an output device interface 1006, a system communications bus 1008, a read-only memory (ROM) 1010, processing unit(s) 1012, an input device interface 1014, and a network interface 1016.

Bus 1008 collectively represents all system, peripheral, and chipset buses that communicatively connect the numerous internal devices of system 1000. For instance, bus 1008 communicatively connects processing unit(s) 1012 with ROM 1010, system memory 1004, and permanent storage device 1002.

From these various memory units, processing unit(s) 1012 retrieves instructions to execute and data to process in order to execute the processes of the subject disclosure. The processing unit(s) can be a single processor or a multi-core processor in different implementations.

ROM 1010 stores static data and instructions that are needed by processing unit(s) 1012 and other modules of system 1000. Permanent storage device 1002, on the other hand, is a read-and-write memory device. This device is a non-volatile memory unit that stores instructions and data even when system 1000 is off. Some implementations of the subject disclosure use a mass-storage device (such as a magnetic or optical disk and its corresponding disk drive) as permanent storage device 1002.

Other implementations use a removable storage device (such as a floppy disk, flash drive, and its corresponding disk drive) as permanent storage device 1002. Like permanent storage device 1002, system memory 1004 is a read-and-write memory device. However, unlike storage device 1002, system memory 1004 is a volatile read-and-write memory, such a random access memory. System memory 1004 stores some of the instructions and data that the processor needs at runtime. In some implementations, the processes of the subject disclosure are stored in system memory 1004, permanent storage device 1002, and/or ROM 1010. For example, the various memory units include instructions for computer aided pipe string design based on existing string designs in accordance with some implementations. From these various memory units, processing unit(s) 1012 retrieves instructions to execute and data to process in order to execute the processes of some implementations.

Bus 1008 also connects to input and output device interfaces 1014 and 1006. Input device interface 1014 enables the user to communicate information and select commands to the system 1000. Input devices used with input device interface 1014 include, for example, alphanumeric, QWERTY, or T9 keyboards, microphones, and pointing devices (also called "cursor control devices"). Output device interfaces 1006 enables, for example, the display of images generated by the system 1000. Output devices used with output device interface 1006 include, for example, printers and display devices, such as cathode ray tubes (CRT) or liquid crystal displays (LCD). Some implementations include devices such as a touchscreen that functions as both input and output devices. It should be appreciated that embodiments of the present disclosure may be implemented using a computer including any of various types of input and output devices for enabling interaction with a user. Such interaction may include feedback to or from the user in different forms of sensory feedback including, but not limited to, visual feedback, auditory feedback, or tactile feedback. Further, input from the user can be received in any form including, but not limited to, acoustic, speech, or tactile input. Additionally, interaction with the user may include transmitting and receiving different types of information, e.g., in the form of documents, to and from the user via the above-described interfaces.

Also, as shown in FIG. 6, bus 1008 also couples system 1000 to a public or private network (not shown) or combination of networks through a network interface 1016. Such a network may include, for example, a local area network ("LAN"), such as an Intranet, or a wide area network ("WAN"), such as the Internet. Any or all components of system 1000 can be used in conjunction with the subject disclosure.

These functions described above can be implemented in digital electronic circuitry, in computer software, firmware or hardware. The techniques can be implemented using one or more computer program products. Programmable processors and computers can be included in or packaged as mobile devices. The processes and logic flows can be performed by one or more programmable processors and by one or more programmable logic circuitry. General and special purpose computing devices and storage devices can be interconnected through communication networks.

Some implementations include electronic components, such as microprocessors, storage and memory that store computer program instructions in a machine-readable or computer-readable medium (alternatively referred to as computer-readable storage media, machine-readable media, or machine-readable storage media). Some examples of such computer-readable media include RAM, ROM, read-only compact discs (CD-ROM), recordable compact discs (CD-R), rewritable compact discs (CD-RW), read-only digital versatile discs (e.g., DVD-ROM, dual-layer DVD-ROM), a variety of recordable/rewritable DVDs (e.g., DVD-RAM, DVD-RW, DVD+RW, etc.), flash memory (e.g., SD cards, mini-SD cards, micro-SD cards, etc.), magnetic and/or solid state hard drives, read-only and recordable Blu-Ray® discs, ultra density optical discs, any other optical or magnetic media, and floppy disks. The computer-readable media can store a computer program that is executable by at least one processing unit and includes sets of instructions for performing various operations. Examples of computer programs or computer code include machine code, such as is produced by a compiler, and files including higher-level code that are executed by a computer, an electronic component, or a microprocessor using an interpreter.

While the above discussion primarily refers to microprocessor or multi-core processors that execute software, some implementations are performed by one or more integrated circuits, such as application specific integrated circuits (ASICs) or field programmable gate arrays (FPGAs). In some implementations, such integrated circuits execute instructions that are stored on the circuit itself. Accordingly, the steps of processes 400 and 500 of FIGS. 4 and 5, respectively, as described above, may be implemented using system 1000 or any computer system having processing circuitry or a computer program product including instructions stored therein, which, when executed by at least one processor, causes the processor to perform functions relating to these methods.

As used in this specification and any claims of this application, the terms "computer", "server", "processor", and "memory" all refer to electronic or other technological devices. These terms exclude people or groups of people. As used herein, the terms "computer readable medium" and "computer readable media" refer generally to tangible, physical, and non-transitory electronic storage mediums that store information in a form that is readable by a computer.

Embodiments of the subject matter described in this specification can be implemented in a computing system that includes a back end component, e.g., as a data server, or that includes a middleware component, e.g., an application server, or that includes a front end component, e.g., a client computer having a graphical user interface or a Web browser through which a user can interact with an implementation of the subject matter described in this specification, or any combination of one or more such back end, middleware, or front end components. The components of the system can be interconnected by any form or medium of digital data communication, e.g., a communication network. Examples of communication networks include a local area network ("LAN") and a wide area network ("WAN"), an internetwork (e.g., the Internet), and peer-to-peer networks (e.g., ad hoc peer-to-peer networks).

The computing system can include clients and servers. A client and server are generally remote from each other and typically interact through a communication network. The relationship of client and server arises by virtue of computer programs running on the respective computers and having a client-server relationship to each other. In some embodiments, a server transmits data (e.g., a web page) to a client device (e.g., for purposes of displaying data to and receiving user input from a user interacting with the client device). Data generated at the client device (e.g., a result of the user interaction) can be received from the client device at the server.

It is understood that any specific order or hierarchy of steps in the processes disclosed is an illustration of exemplary approaches. Based upon design preferences, it is understood that the specific order or hierarchy of steps in the processes may be rearranged, or that all illustrated steps be performed. Some of the steps may be performed simultaneously. For example, in certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

Furthermore, the exemplary methodologies described herein may be implemented by a system including processing circuitry or a computer program product including instructions which, when executed by at least one processor, causes the processor to perform any of the methodology described herein.

Embodiments Disclosed Herein Include

A: A system that includes at least one processor, and a memory coupled to the at least one processor having instructions stored therein. When executed by the at least one processor, the instructions cause the at least one processor to perform functions including functions to: apply a treatment in at least a first well of a plurality of wells in a subterranean formation; determine a flow distribution based on at least one of a first-well measurement or a second-well measurement, wherein the first-well measurement is taken at the first well, and wherein the second-well measurement is taken at a second well of the plurality of wells; determine a length of a fracture between the first well and the second well, based on the determined flow distribution; determine if the applied treatment at the first well interferes with the second well, based on the determined length of the fracture; and apply a diverting material at the first well if it is determined that the applied treatment interferes with the second well, in order to control well bashing of the second well.

B: A method of controlling well bashing during stimulation treatment. The method includes applying a treatment in at least a first well of a plurality of wells in a subterranean formation. The method further includes determining a flow distribution based on at least one of a first-well measurement or a second-well measurement, wherein the first-well measurement is taken at the first well, and wherein the second-well measurement is taken at a second well of the plurality of wells. The method further includes determining a length of a fracture between the first well and the second well, based on the determined flow distribution, and determining if the applied treatment at the first well interferes with the second well, based on the determined length of the fracture. The method further includes applying a diverting material at the first well if it is determined that the applied treatment interferes with the second well, in order to control well bashing of the second well.

Each of the embodiments, A and B, may have one or more of the following additional elements in any combination. Element 1: wherein the instructions further cause the at least one processor to perform functions to: obtain the second-well measurement, concurrent with applying the treatment at the first well, wherein the instructions cause the at least one processor to determine the flow distribution by determining the flow distribution based on the obtained second-well measurement. Element 2: wherein: the second well is adjacent to the first well; and the instructions cause the at least one processor to determine if the applied treatment at the first well interferes with the second well by comparing the determined length of the fracture with a known distance between the first well and the second well. Element 3: wherein: the instructions cause the at least one processor to apply the treatment by applying the treatment at the second well; and the instructions further cause the at least one processor to perform functions to determine a second flow distribution, based on at least one of the first-well measurement or the second-well measurement. Element 4: wherein the instructions further cause the at least one processor to perform functions to: determine a length of a second fracture between the first well and the second well, based on the determined second flow distribution. Element 5: wherein the instructions further cause the at least one processor to perform functions to: determine if the applied treatment at the second well interferes with the first well, based on the determined length of the second fracture. Element 6: wherein: the instructions cause the at least one processor to determine if the applied treatment at the second well interferes with the first well by comparing a sum of the determined length of the fracture and the determined length of the second fracture, with a known distance between the first well and the second well; or the instructions cause the at least one processor to determine if the applied treatment at the first well interferes with the second well by comparing the sum of the determined length of the fracture and the determined length of the second fracture, with the known distance between the first well and the second well. Element 7: wherein the instructions cause the at least one processor to apply the treatment by applying the treatment at a third well of the plurality of wells. Element 8: wherein the application of the treatment at the first well occurs concurrent with the application of the treatment at the third well.

Element 9: further including: obtaining the second-well measurement, concurrent with applying the treatment at the first well, wherein determining the flow distribution includes determining the flow distribution based on the obtained second-well measurement. Element 10: wherein: the second well is adjacent to the first well; and determining if the applied treatment at the first well interferes with the second well includes comparing the determined length of the fracture with a known distance between the first well and the second well. Element 11: wherein: applying the treatment includes applying the treatment at the second well; and the method further includes determining a second flow distribution, based on at least one of the first-well measurement or the second-well measurement. Element 12: further including: determining a length of a second fracture between the first well and the second well, based on the determined second flow distribution. Element 13: further including: determining if the applied treatment at the second well interferes with the first well, based on the determined length of the second fracture. Element 14: wherein: determining if the applied treatment at the second well interferes with the first well includes comparing a sum of the determined length of the fracture and the determined length of the second fracture, with a known distance between the first well and the second well; or determining if the applied treatment at the first well interferes with the second well includes comparing the sum of the determined length of the fracture and the determined length of the second fracture, with the known distance between the first well and the second well. Element 15: wherein applying the treatment includes applying the treatment at a third well of the plurality of wells. Element 16: wherein the application of the treatment at the first well occurs concurrent with the application of the treatment at the third well. Element 17: wherein determining the flow distribution includes determining the flow distribution across a plurality of clusters at the first well, based on at least one of a DAS measurement, a distributed optic strain sensing measurement, a DTS measurement, a microseismic activity measurement, a surface treating pressure measurement, or a tiltmeter measurement. Element 18: wherein applying the treatment, determining the flow distribution, determining the length of the fracture, determining if the applied treatment at the first well interferes, and applying the diverting material at the first well are performed in real-time during the stimulation treatment.

Numerous other variations and modifications will become apparent to those skilled in the art once the above disclosure is fully appreciated. For example, in some embodiments, the order of the processing operations described herein may vary and/or be performed in parallel. It is intended that the following claims be interpreted to embrace all such variations and modifications where applicable.

What is claimed is:

1. A method of controlling well bashing during stimulation treatment, comprising:

applying a treatment to at least a first well of a plurality of wells in a subterranean formation;

collecting a first-well measurement from the first well and a second-well measurement from a second well penetrating the subterranean formation, wherein at least the second well includes a fiber-optic sensor configured for distributed sensing along the second well;

determining a flow distribution across a plurality of formation entry points along a portion of the first well using at least one of the first-well measurement or the second-well measurement, wherein the first-well measurement is taken at the first well, and wherein the second-well measurement is taken at a plurality of locations along the second well and comprises measurements from the fiber-optic sensor;

determining a fracture volume of injection fluid entering the plurality of formation entry points using the determined flow distribution across the plurality of formation entry points; determining a fracture length between the first well and the second well based on a relationship of the fracture volume with the fracture length, Young's modulus, a fracture height, a stress intensity factor, and Poisson's ratio, wherein the relationship is described by an equation:

$$V_{fp} = \frac{\sqrt{\pi}(1-v^2)hK_{IC}}{2E}L_f^{3/2}$$

wherein $V_{fp}$ denotes the fracture volume, E denotes Young's modulus, h denotes the fracture height, $K_{IC}$ denotes the stress intensity factor, v denotes Poisson's ratio, and $L_f$ denotes the fracture length;

determining if the applied treatment at the first well interferes with the second well, using the determined length of the fracture; and making real-time adjustments to a baseline treatment schedule responsive to the determined flow distribution to control a diverter deployment over the course of a treatment stage of the stimulation treatment, wherein the diverter deployment comprises applying a diverting material at the first well if it is determined that the applied treatment interferes with the second well, in order to control well bashing of the second well.

2. The method of claim 1, further comprising:

obtaining the second-well measurement, concurrent with applying the treatment at the first well, wherein determining the flow distribution comprises determining the flow distribution using the obtained second-well measurement.

3. The method of claim 1, wherein:

the second well is adjacent to the first well; and determining if the applied treatment at the first well interferes with the second well comprises comparing the determined length of the fracture with a known distance between the first well and the second well.

4. The method of claim 1, wherein:

applying the treatment comprises applying the treatment at the second well; and the method further comprises determining a second flow distribution, using at least one of the first-well measurement or the second-well measurement.

5. The method of claim 1, further comprising:

determining if the applied treatment at the second well interferes with the first well, using the determined length of the second fracture.

6. The method of claim 5, wherein:

determining if the applied treatment at the second well interferes with the first well comprises comparing a sum of the determined length of the fracture and the determined length of the second fracture, with a known distance between the first well and the second well; or determining if the applied treatment at the first well interferes with the second well comprises comparing the sum of the determined length of the fracture and the determined length of the second fracture, with the known distance between the first well and the second well.

7. The method of claim 1, wherein applying the treatment comprises applying the treatment at a third well of the plurality of wells.

8. The method of claim 7, wherein the application of the treatment at the first well occurs concurrent with the application of the treatment at the third well.

9. The method of claim 1, wherein determining the flow distribution across the plurality of formation entry points comprises determining the flow distribution across a plurality of perforation clusters along a cased portion of the wellbore path, open-hole sections along an uncased portion of the wellbore path, ports of a sliding sleeve completion device along the wellbore path, slots of a perforated liner along the wellbore path, or any combination of the foregoing at the first well, using a distributed acoustic sensing (DAS) measurement, a distributed optic strain sensing measurement, a distributed temperature sensing (DTS) measurement, or a microseismic activity measurement.

10. The method of claim 1, wherein applying the treatment, determining the flow distribution, determining the length of the fracture, determining if the applied treatment at the first well interferes, and applying the diverting material at the first well are performed in real-time during the course of the treatment stage of the stimulation treatment.

11. A system for controlling well bashing during stimulation treatment, comprising:

at least one processor; and a memory coupled to the at least one processor having instructions stored therein, which when executed by the at least one processor, cause the at least one processor to perform functions including functions to:

apply a treatment to at least a first well of a plurality of wells in a subterranean formation;

collect a first-well measurement from the first well and a second-well measurement from a second well penetrating the subterranean formation, wherein at least the second well includes a fiber-optic sensor configured for distributed sensing along the second well;

determine a flow distribution across a plurality of formation entry points along a portion of the first well by determining the respective volumes of injection fluid that are entering the plurality of formation entry points using at least one of the first-well measurement or the second-well measurement, wherein the first-well measurement is taken at the first well, and wherein the second-well measurement is taken at a plurality of locations along a second well of the plurality of wells and comprises measurements from the fiber-optic sensor;

determine a fracture volume of injection fluid entering the plurality of formation entry points using the determined flow distribution across the plurality of formation entry points;

determine a fracture length between the first well and the second well based on a relationship of the fracture volume with the fracture length, Young's modulus, a fracture height, a stress intensity factor, and Poisson's ratio, wherein the relationship is described by an equation:

$$V_{fp} = \frac{\sqrt{\pi}(1-v^2)hK_{IC}}{2E}L_f^{3/2}$$

wherein $V_{fp}$ denotes the fracture volume, E denotes Young's modulus, h denotes the fracture height, $K_{IC}$ denotes the stress intensity factor, v denotes Poisson's ratio, and $L_f$ denotes the fracture length;

determine if the applied treatment at the first well interferes with the second well, using the determined length of the fracture; and make real-time adjustments to a baseline treatment schedule responsive to the determined flow distribution to control a diverter deployment over the course of a treatment stage of the stimulation treatment, wherein the diverter deployment comprises applying a diverting material at the first well if it is determined that the applied treatment interferes with the second well, in order to control well bashing of the second well.

12. The system of claim 11, wherein:

the second well is adjacent to the first well; and the instructions cause the at least one processor to determine if the applied treatment at the first well interferes with the second well by comparing the determined length of the fracture with a known distance between the first well and the second well.

13. The system of claim 11, wherein:

the instructions cause the at least one processor to apply the treatment by applying the treatment at the second well; and the instructions further cause the at least one processor to perform functions to determine a second flow distribution, using at least one of the first-well measurement or the second-well measurement.

14. The system of claim 13, wherein the instructions further cause the at least one processor to perform functions to:

determine a length of a second fracture between the first well and the second well, using the determined second flow distribution.

15. The system of claim 14, wherein the instructions further cause the at least one processor to perform functions to:

determine if the applied treatment at the second well interferes with the first well, using the determined length of the second fracture.

16. The system of claim 15, wherein:

the instructions cause the at least one processor to determine if the applied treatment at the second well interferes with the first well by comparing a sum of the determined length of the fracture and the determined length of the second fracture, with a known distance between the first well and the second well; or the instructions cause the at least one processor to determine if the applied treatment at the first well interferes with the second well by comparing the sum of the determined length of the fracture and the determined length of the second fracture, with the known distance between the first well and the second well.

17. The system of claim 11, wherein the instructions cause the at least one processor to apply the treatment by applying the treatment at a third well of the plurality of wells.

18. The system of claim 17, wherein the application of the treatment at the first well occurs concurrent with the application of the treatment at the third well.

* * * * *